US012680434B2

(12) United States Patent
Vasper et al.

(10) Patent No.: US 12,680,434 B2
(45) Date of Patent: Jul. 14, 2026

(54) WELL RELATED INJECTION PRESSURE REGULATION METHODS AND SYSTEMS

(71) Applicant: Schlumberger Technology Corporation, Sugar Land, TX (US)

(72) Inventors: Adam Vasper, Bucharest (RO); Jeremie Poizat, Houston, TX (US); Oguzhan Guven, Rosharon, TX (US); Garis Mccutcheon, Houston, TX (US); Nabil Batita, Houston, TX (US); Benoit Deville, Houston, TX (US); Stephen Dyer, Houston, TX (US)

(73) Assignee: Schlumberger Technology Corporation, Sugar Land, TX (US)

( * ) Notice: Subject to any disclaimer, the term of this patent is extended or adjusted under 35 U.S.C. 154(b) by 109 days.

(21) Appl. No.: 18/725,282

(22) PCT Filed: May 23, 2023

(86) PCT No.: PCT/US2023/023218

§ 371 (c)(1),
(2) Date: Jun. 28, 2024

(87) PCT Pub. No.: WO2023/230052

PCT Pub. Date: Nov. 30, 2023

(65) Prior Publication Data

US 2025/0109669 A1 Apr. 3, 2025

Related U.S. Application Data

(60) Provisional application No. 63/345,021, filed on May 23, 2022.

(51) Int. Cl.
*E21B 43/16* (2006.01)
*E21B 34/06* (2006.01)
(Continued)

(52) U.S. Cl.
CPC ..... *E21B 43/164* (2013.01); *E21B 34/066* (2013.01); *E21B 43/10* (2013.01);
(Continued)

(58) Field of Classification Search
CPC ..... E21B 43/164; E21B 43/12; E21B 43/10; E21B 2200/02; E21B 34/066; E21B 41/0064; Y02P 90/70
See application file for complete search history.

(56) References Cited

U.S. PATENT DOCUMENTS 9,163,489 B2 10/2015 Cawley et al.
10,844,680 B2 11/2020 Ross et al.
(Continued)

FOREIGN PATENT DOCUMENTS

EP 2729658 B1 9/2017
WO 2020223437 A1 11/2020

OTHER PUBLICATIONS

Weatherford Downhole Choke (Weatherford.com; 2008-2011) (Year: 2011).*

*Primary Examiner* — George S Gray
(74) *Attorney, Agent, or Firm* — Kyle R. Miiller

(57) ABSTRACT

A technique facilitates regulation of pressure in a well to avoid deleterious effects. The technique involves use of a completion deployed downhole in a borehole. The completion may comprise a variety of equipment assembled to facilitate a desired injection operation. A choke is positioned below, i.e. downhole, of the equipment. When an injection fluid is delivered down through the completion, the choke is able to provide a desired pressure regulation. For example, the choke may be controlled or otherwise utilized so as to control pressure of the injection fluid such that the injection fluid above the choke is maintained at a pressure higher than the liquid to gas transition level of the injection fluid.

22 Claims, 6 Drawing Sheets

(51) Int. Cl.
*E21B 41/00* (2006.01)
*E21B 43/10* (2006.01)
*E21B 43/12* (2006.01)

(52) U.S. Cl.
CPC ..... *E21B 41/0064* (2013.01); *E21B 43/12* (2013.01); *E21B 2200/02* (2020.05)

(56) References Cited

U.S. PATENT DOCUMENTS

| | | | | |
|---|---|---|---|---|
| 2010/0096127 | A1 | 4/2010 | Jordy | |
| 2011/0036575 | A1 | 2/2011 | Cavender et al. | |
| 2012/0003043 | A1* | 1/2012 | Cawley | E21B 43/164 405/53 |
| 2014/0182857 | A1* | 7/2014 | Klompsma | E21B 43/255 166/310 |
| 2021/0332668 | A1* | 10/2021 | Fripp | E21B 47/12 |
| 2022/0333460 | A1* | 10/2022 | Fripp | E21B 34/101 |

* cited by examiner

WELL RELATED INJECTION PRESSURE REGULATION METHODS AND SYSTEMS

CROSS-REFERENCE TO RELATED APPLICATION

The present document is a National Stage Entry of International Application No. PCT/US2023/023218, filed May 23, 2023, which is based on and claims priority to U.S. Provisional Application Ser. No. 63/345,021, filed May 23, 2022, which is incorporated herein by reference in its entirety.

BACKGROUND

Hydrocarbon fluids such as oil and natural gas are obtained from a subterranean geologic formation via a well. During development and/or operation of the well, the well may be subjected to various service treatments. Examples of service treatments include the injection of fluids, e.g. carbon dioxide (CO2), in the actual production well or in a related injection well. The injection fluids may be delivered to the well and down through a well completion in a liquid or dense phase (even supercritical). However, if the injection fluid undergoes a liquid to gas transition in the well completion then substantial and undesirable temperature drops may occur due to the phase transition energy transfer. The substantial temperature drops can detrimentally affect completion components and/or the surrounding wellbore wall. Detrimental effects may include cryogenically induced failures of metals, seals, or cement as well as the freezing of wellbore fluids and/or hydraulic fluids.

SUMMARY

In general, a methodology and system are provided for facilitating the regulation of pressure in a borehole to avoid deleterious effects. The technique involves use of a completion deployed downhole in a borehole. The completion may comprise a variety of equipment assembled to facilitate a desired injection operation. A choke is positioned below, i.e. downhole, of the equipment. When an injection fluid is delivered down through the completion, the choke is able to provide a desired pressure regulation. For example, the choke may be controlled or otherwise utilized so as to control pressure of the injection fluid such that the injection fluid above the choke is maintained at a pressure higher than the liquid to gas transition level of the injection fluid. This ensures the injection fluid does not undergo a fluid phase transition which would create detrimental cooling in proximity to the equipment and other features of the well.

However, many modifications are possible without materially departing from the teachings of this disclosure. Accordingly, such modifications are intended to be included within the scope of this disclosure as defined in the claims.

BRIEF DESCRIPTION OF THE DRAWINGS

Certain embodiments of the disclosure will hereafter be described with reference to the accompanying drawings, wherein like reference numerals denote like elements. It should be understood, however, that the accompanying figures illustrate the various implementations described herein and are not meant to limit the scope of various technologies described herein, and.

DETAILED DESCRIPTION

Figure 1:
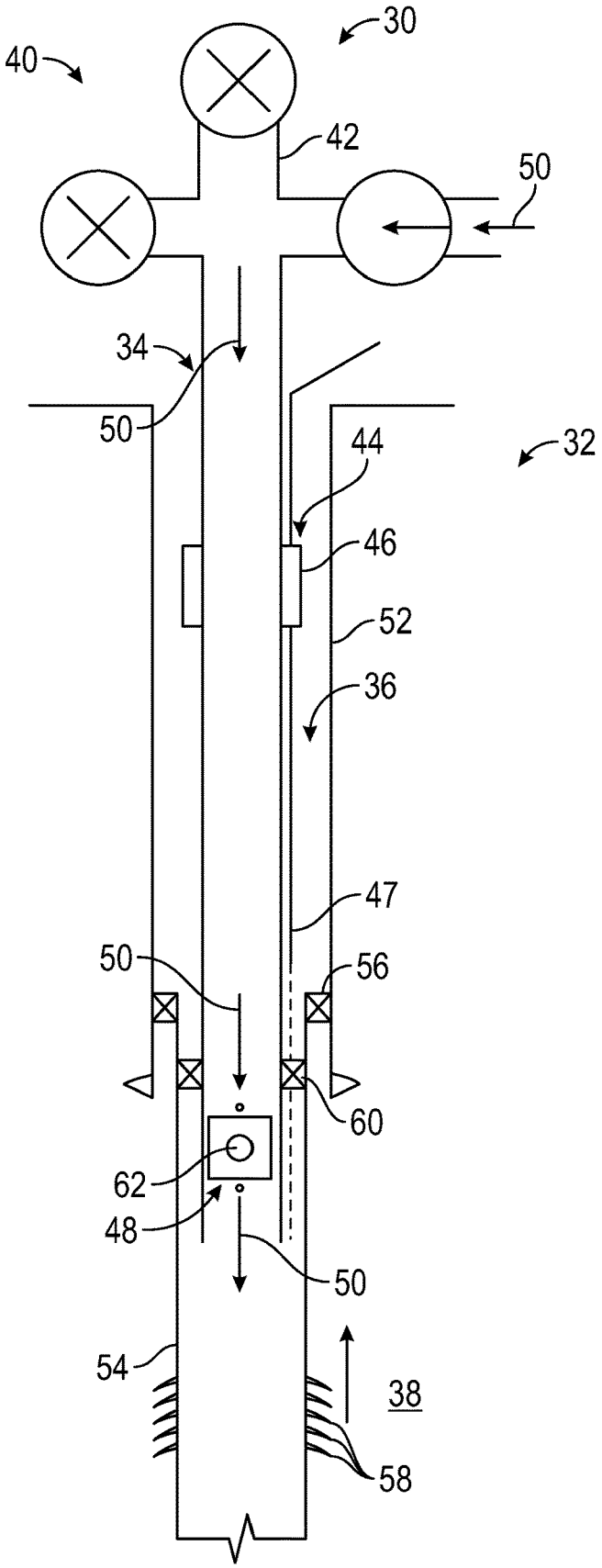
FIG. 1 is an illustration of an example of a well having a borehole with a completion in which a choke is used to provide pressure regulation, according to an embodiment of the disclosure.

In the following description, numerous details are set forth to provide an understanding of some embodiments of the present disclosure. It is to be understood that the following disclosure provides many different embodiments, or examples, for implementing different features of various embodiments. Specific examples of components and arrangements are described below to simplify the disclosure. These are, of course, merely examples and are not intended to be limiting. However, it will be understood those of ordinary skill in the art that the system and/or methodology may be practiced without these details and that numerous variations or modifications from the described embodiments may be possible. This description is not to be taken in a limiting sense, but rather for the purpose of describing general principles of the implementations. The scope of the described implementations should be ascertained with reference to the issued claims.

As used herein, the terms “connect”, “connection”, “connected”, “in connection with”, and “connecting” are used to mean “in direct connection with” or “in connection with via one or more elements"; and the term "set" is used to mean "one element" or "more than one element". Further, the terms "couple", "coupling", "coupled", "coupled together", and "coupled with" are used to mean "directly coupled together" or "coupled together via one or more elements". As used herein, the terms "up" and "down"; "upper" and "lower"; "top" and "bottom"; and other like terms indicating relative positions to a given point or element are utilized to more clearly describe some elements. Commonly, these terms relate to a reference point at the surface from which drilling operations are initiated as being the top point and the total depth being the lowest point, wherein the well (e.g., wellbore, borehole) is vertical, horizontal or slanted relative to the surface.

The disclosure herein generally involves a methodology and system for facilitating the regulation of pressure in a well to avoid deleterious effects. The technique involves use of a completion deployed downhole in a borehole of the well. The completion may comprise a variety of equipment assembled to facilitate a desired injection operation. For example, the completion may be constructed to facilitate a CO2 injection operation in which carbon dioxide is injected into the formation surrounding the borehole.

According to an embodiment, a choke is positioned below, i.e. downhole, of the equipment. When an injection fluid is delivered down through the completion, the choke is able to provide a desired pressure regulation. For example, the choke may be controlled or otherwise utilized so as to control pressure of the injection fluid such that the injection fluid above the choke is maintained at a pressure higher than the liquid to gas transition level of the injection fluid. This ensures the injection fluid does not undergo a fluid phase transition which would create detrimental cooling in proximity to the equipment and other features of the well. When pressure reduces below a liquid to gas transition line with respect to various fluids, then there is a high likelihood of a substantial temperature drop due to the phase transition energy transfer.

By preventing the phase change, the completion equipment, as well as the borehole wall materials, may be protected against freezing or other undesirable effects that would result from the cooling associated with a phase change. For example, prevention of the phase change can be important in reducing the impact on wellbore completion components and/or the surrounding wellbore wall by lowering the risk of cryogenically induced failures of metals, seals, or cement and by reducing the potential for freezing of wellbore and/or hydraulic fluids.

Embodiments described herein allow an operator to inject a fluid, e.g. CO2, at a supercritical or dense phase into a low-pressure formation while maintaining the fluid in the same phase throughout the wellbore above the position of the choke (which serves as a pressure regulator). This, in turn, reduces the temperature drops experienced by the components, e.g. equipment, within the well, thus reducing risk of failure due to potentially cryogenic conditions. Depending on the environment and equipment, the undesirable cryogenic conditions may occur at various temperature levels, e.g. −35° C., −78° C., or other temperature levels.

As described herein, various types of chokes may be used as pressure regulators to protect against the unwanted decrease in temperature. Examples include mechanical chokes which may be fixed or spring-loaded. Other examples include actively controlled chokes which may be hydraulically or electrically adjustable. Power for the actuation may be provided via cables run along the outside of the completion, via an inductive coupling link between the completion and the active choke, and/or wirelessly through remote power harvesting from, for example, the injection fluid flow. The choke devices may be integrated with a reverse flow check valve capability to prevent reservoir fluids from flowing back into the wellbore after a well shut in or after an undesirable event.

Referring generally to FIG. 1, a well injection system 30 is illustrated for use with respect to a well 32. The system 30 may comprise a completion 34 deployed within a borehole 36, e.g. a wellbore, drilled into a subterranean formation 38. In this example, the completion 34 may be deployed downhole beneath surface equipment 40, which may include a wellhead 42. The completion 34 may comprise various types of equipment 44 configured to facilitate the desired injection operation and/or other well related operations. By way of example, the equipment 44 may comprise a subsurface safety valve 46, a sensor system 47, e.g. a fiber-optic measurement system, and various other components, features, and systems.

According to this embodiment, a choke 48 provides pressure regulation and is positioned along the completion 34 at a location beneath the equipment 44, e.g. beneath subsurface safety valve 46. The choke 48 is used to control pressure of an injection fluid represented by arrows 50. Effectively, the choke 48 controls the pressure of the injection fluid 50 such that the injection fluid 50 above the choke 48 is maintained at a pressure above the liquid to gas transition line/level of the injection fluid 50. By way of example, injection fluid 50 may comprise CO2 although various other types of injection fluid 50 may be utilized for a given injection operation.

The overall configuration of well 32 may vary according to environmental considerations, equipment, and/or operational parameters. According to one example, the borehole 36 is lined with a well casing 52. Additionally, a liner 54 is suspended downhole in the borehole 36 via a liner hanger 56 secured to well casing 52. It should be noted the liner hanger 56 may be received in other types of tubing or components in other types of well systems. The liner 54 may comprise various types of perforations 58 which enable communication between an interior of the liner 54 and the surrounding formation 38.

In the example illustrated, completion 34 is deployed down into liner 54. The completion 34 may be sealed with respect to an interior of the liner 54 via a packer 60 or other suitable sealing device. In this embodiment, the choke 48 is positioned along completion 34 at a location within liner 54 once the completion 34 is deployed downhole into the liner 54.

During an injection operation, the injection fluid 50, e.g. CO2, may be injected from the surface down through the wellhead 42, down through completion equipment 44 (including subsurface safety valve 46), down into the wellbore 36 or other type of borehole, and out through perforations 58. By way of example, the injection pressure of the CO2 injection fluid 50 may be approximately 80 bar when delivered through wellhead 42 and down into completion 34. With CO2 injection, this pressure level represents a minimum pressure required to maintain the CO2 in its dense phase, thus avoiding having the injection fluid 50 flash to a gas phase which causes the associated temperature drop.

In this particular example, the downhole choke 48 is positioned above or below the packer 60 but at a sufficient depth to benefit from the natural geothermal profile of the subsurface which is at an elevated temperature relative to the temperature at the surface. The subterranean formation 38, e.g. a reservoir, in this example is depleted and at a relatively low pressure, e.g. 40 bar. This pressure would not be able to hold a column of CO2 in dense phase.

However, the choke 48 is constructed to provide a pressure drop while maintaining the fluid pressure of the injection fluid 50 above (uphole) of choke 48 at a higher pressure than the flash pressure, e.g. higher than the liquid to gas transition pressure. By way of example, the choke 48 may maintain pressure of the injection fluid 50 at 150 bar immediately above the choke 48 while allowing a reduction in that pressure as the injection fluid 50 passes through the choke 48. If the reservoir pressure below the choke 48 is 40 bar, for example, the injection fluid 50 will flash to gas and there will be an associated temperature drop but this occurs at a location below the choke 48 so as to avoid damaging completion equipment 44 and other susceptible components.

By maintaining this higher pressure above choke 48, the minimum temperature of the injection fluid 50 remains higher at completion equipment 44 as compared to allowing a similar pressure drop at the surface. Accordingly, the subsurface safety valve 46 and other equipment 44, along with various borehole components, are protected against the detrimental cold temperatures. In some embodiments, the choke 48 may include or may be combined with a check valve 62 to prevent reverse flow when injection is stopped and/or when the well is shut in. It should be noted the pressures provided herein are given simply as examples associated with one type of CO2 injection operation. However, the relative pressures vary with the type of fluid being injected and also with temperatures, depths, and other factors that may affect, for example, the flash point of the fluid being injected.

Figure 2:
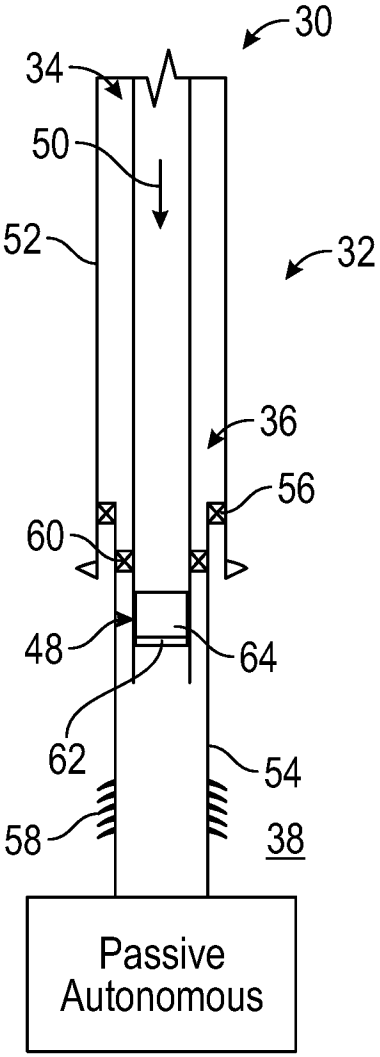
FIG. 2 is an illustration of another example of a well having a borehole with a completion in which a choke is used to provide pressure regulation, according to an embodiment of the disclosure.

Referring generally to FIG. 2, one example of well injection system 30 is illustrated in which the choke 48 is in the form of a passive or autonomous choke 64. The passive choke 64 may be a mechanical device that operates as a simple downhole choke. In some embodiments, the passive choke 64 may be combined with check valve 62, e.g. a flapper seal device type check valve, to provide additional reverse check capability.

Additionally, the passive choke 64 may be spring loaded via, for example, a nitrogen spring, a pressure piloted spring, an atmospheric piloted spring, or another suitable type of spring, to allow a level of adjustability. The functional objective of a spring-loaded choke 64 is for the choke to provide a set upstream minimum pressure before it can open. Once opened, the choke 64 is able to maintain that minimum pressure for as wide a range of injection rates as possible. The choke 64 may be installed as part of the completion 34 or it may be subsequently introduced via, for example, wireline, coiled tubing, or another suitable deployment mechanism.

Figure 3:
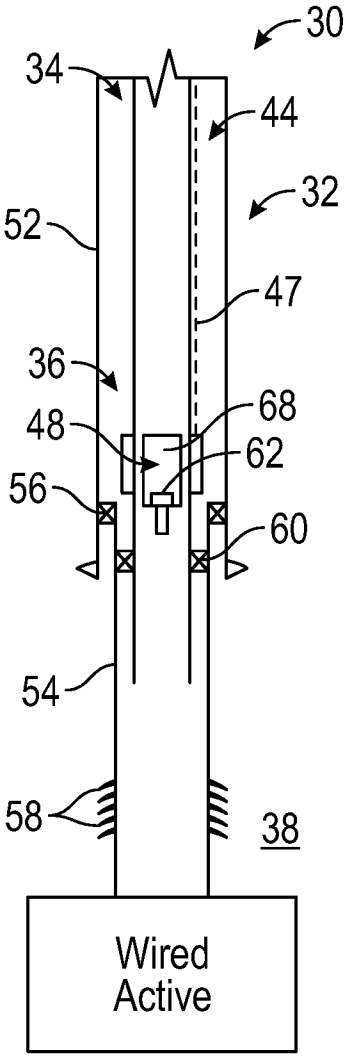
FIG. 3 is an illustration of another example of a well having a borehole with a completion in which a choke is used to provide pressure regulation, according to an embodiment of the disclosure.

Referring generally to FIG. 3, another example of well injection system 30 is illustrated in which the choke 48 is in the form of an active, controlled choke 68 which can be controlled from the surface. Examples of such active choke 68 include hydraulically actuated chokes, electrohydraulically actuated chokes, or electrically actuated chokes which utilize sleeves or other mechanisms to enable selection of different effective choke settings/sizes. This adjustability enables an operator to set the choke to maintain a suitable back pressure while still allowing for a wide range of injection rates.

The active choke 68 also may be combined with the check valve 62, e.g. a flapper seal device type check valve, to provide additional reverse check capability. The check valve 62 may be automated to enable controlled closing upon, for example, injection interruption. In some embodiments, the active choke 68 may be deployed permanently as part of a suitable completion 34, such as an intelligent completion. In other embodiments, the active choke 68 may be deployed with electric power and comms running to the surface or with, for example, an inductive coupler able to communicate with power and comms routed along the completion 34.

Figure 4:
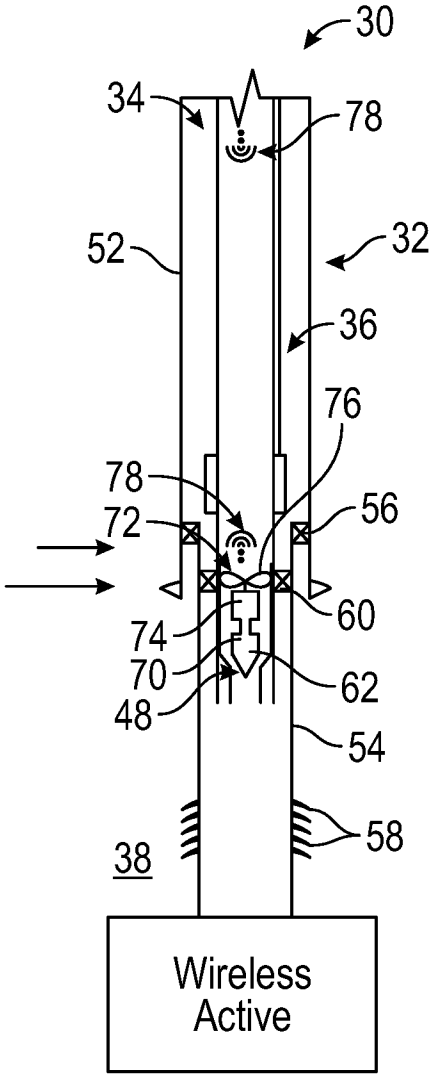
FIG. 4 is an illustration of another example of a well having a borehole with a completion in which a choke is used to provide pressure regulation, according to an embodiment of the disclosure.

Referring generally to FIG. 4, another example of well injection system 30 is illustrated in which the choke 48 is in the form of a wireless active choke 70. Power for controlling the wireless active choke 70 may be provided by a downhole power source 72, e.g. a downhole power generator 74 driven by an impeller/turbine 76. The electric power is provided to suitable electronics of the choke 70 so as to power a variable choking device, e.g. sleeve, plunger, or other adjustable choke.

Communication with the surface may be achieved via a wireless communication system 78, such as an acoustic telemetry system or mud pulse telemetry system, which allows for bidirectional communication to and from a corresponding surface controller. The wireless active choke 70 may be run in hole as part of the completion 34 or it may be subsequently deployed down through completion 34 via, for example, a suitable intervention technique.

Depending on the type of environment and the parameters of a given injection operation, completion 34 may be constructed in a variety of configurations which may include intelligent completion configurations. Some configurations of completion 34 may be constructed with the choke 48 as an integral part of the completion while other configurations of completion 34 may be constructed to provide the capability for accepting the choke 48 via, for example, intervention when needed. The completion 34 also may be constructed to accommodate actively controlled choke systems and passive/autonomous choke systems.

Figure 5:
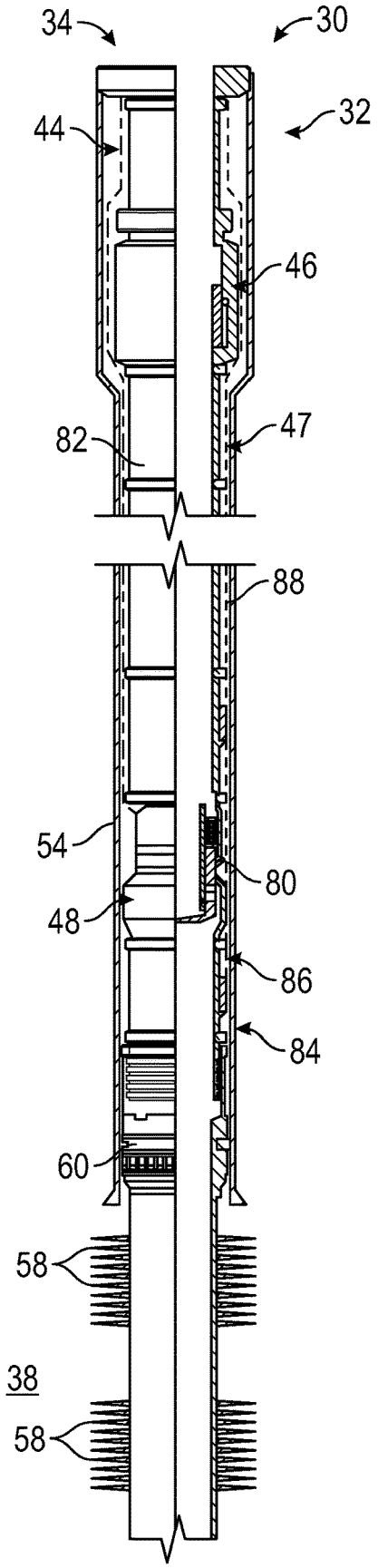
FIG. 5 is an illustration of another example of a well having a borehole with a completion in which a choke is used to provide pressure regulation, according to an embodiment of the disclosure.

For example, FIG. 5 illustrates a permanently deployed intelligent completion 34 in which the choke 48 is in the form of a hydraulically or electrically actuated inline injection control valve 80. In this example, completion 34 comprises an upper completion 82 which is stung, sealed, and anchored in a liner tieback receptacle 84 that protects the well casing 52 from injection fluids. The upper completion 82 may include subsurface safety valve 46. In this example, the tieback receptacle 84 comprises or works in cooperation with a latched seal assembly although a fixed production packer could be used instead.

The subsurface safety valve 46 has a sufficiently sized internal diameter to allow maximum gas phase injection rates. Monitoring may be provided by various types of sensor systems 47, and one example comprises a combined optical fiber DAS/DTS (distributed acoustic sensor/distributed temperature sensor) system 86 packaged in a hybrid cable 88. In some embodiments, the hybrid cable 88 may include an electric line which connects downhole sensors such as pressure and temperature gauges. For example, single or dual sensors/gauges may be located above and/or below the injection control valve 80 to enable monitoring of injection conditions throughout. Optical fiber surveillance systems such as system 86 may be used to monitor well integrity, injection phase, micro-seismic acquisition, and 3D VSP seismic acquisition.

The inline injection control valve 80 may utilize various types of chokes, e.g. fixed discrete chokes or continuous multiposition chokes, to control the flow of injection fluid 50 therethrough. Chokes associated with injection control valve 80 (as well as other chokes 48 described herein) may be constructed from hard, erosion resistant materials such as carbide.

This type of embodiment of completion 34 allows gas phase injection in an un-choked position. Once dense phase injection is initiated, the choke 48/injection control valve 80 may be used to provide an adjustable back pressure which maintains injection fluid conditions in dense phase throughout the borehole 36 above this location. As with certain other embodiments, the ability to close off choke 48/injection control valve 80 facilitates testing of the subsurface safety valve 46 by allowing a high dense phase pressure to be trapped in the wellbore above the injection control valve 80 and by minimizing the thermal transients accruing at the valve 46 due to bleed off during routine flapper leak testing. Additionally, the choke 48/injection control valve 80 may be closed if or when injection is stopped so as to eliminate reverse flow from the reservoir/formation 38 and back up through the completion 34.

Figure 6:
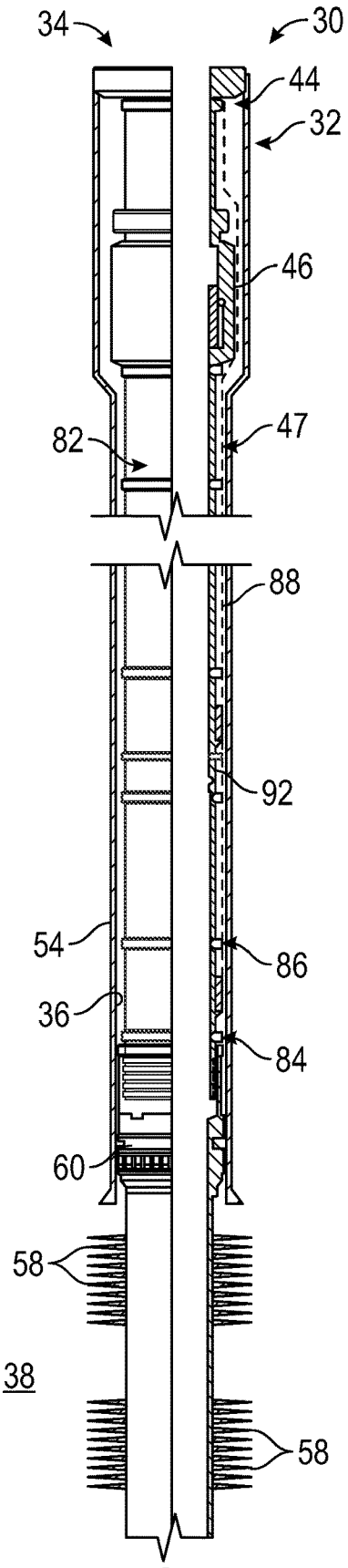
FIG. 6 is an illustration of another example of a well having a borehole with a completion constructed to receive a choke for pressure regulation, according to an embodiment of the disclosure.
Figure 7:
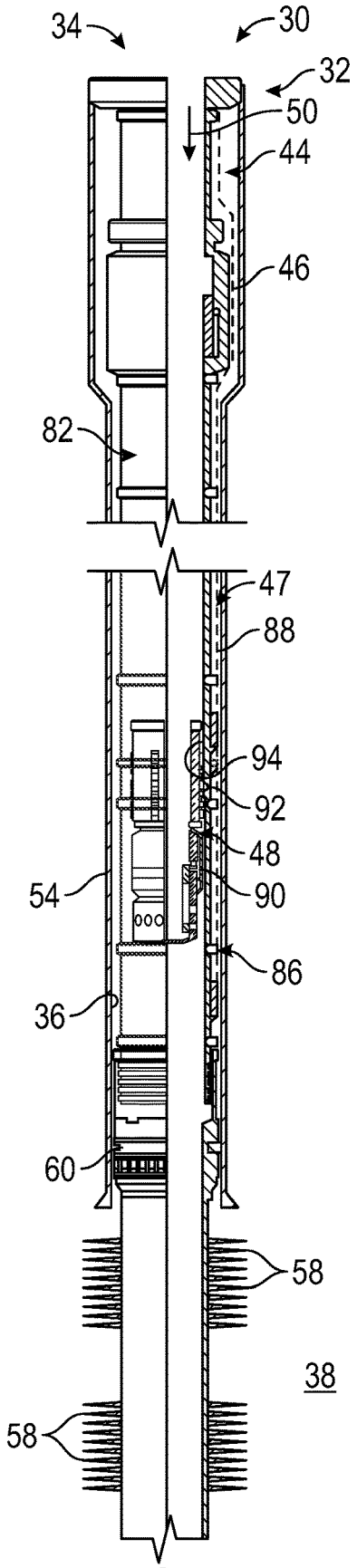
FIG. 7 is an illustration of another example of a well having a borehole with a completion having a choke received in the completion to provide pressure regulation, according to an embodiment of the disclosure.

Referring generally to FIGS. 6 and 7, another embodiment of well injection system 30 and completion 34 is illustrated. In this example, completion 34 is a relatively simple, monobore completion. As illustrated, completion 34 again comprises an appropriate upper completion 82 which is stung, sealed, and anchored in the liner tieback receptacle 84 that protects the upper casing from injection fluids. In some embodiments, the subsurface safety valve 46 may be run below a tubing hanger. The subsurface safety valve 46 may be electrically or hydraulically actuated from the surface to enable well shut down in case of catastrophic rupture of surface or seabed wellhead equipment.

As with some other embodiments, monitoring may be provided by various types of sensor systems 47, and one example comprises the combined optical fiber DAS/DTS system 86 packaged in a hybrid cable 88. In some embodiments, the hybrid cable 88 may include an electric line which connects downhole sensors such as pressure and temperature gauges. The sensors/gauges may be located above and/or below the choke 48 once installed.

In this example, choke 48 comprises a mechanical autonomous choke 90 which can be deployed down through completion 34 and captured at a desired location. For example, the completion 34 may comprise an internal nipple profile 92 (see FIG. 6) positioned to engage a lock mandrel 94 of the mechanical autonomous choke 90 when the choke 90 is run downhole (see FIG. 7). The autonomous mechanical choke 90 may be run down through completion 34 on wireline (or via other suitable conveyance) at the start of a dense phase injection of injection fluid 50.

It should be noted that embodiments of mechanical autonomous choke 90 may utilize a piloted fixed back pressure at variable injection rate conditions. In some embodiments, the mechanical autonomous choke 90 may be in the form of an internally sprung choke which provides a minimum "crack open pressure" condition such that the choke 90 remains closed until fluid pressure is sufficient, thus maintaining the injection fluid 50 above choke 90 in the dense phase condition. Once sufficient pressure opens choke 90, the spring (or other suitable mechanism) allows choke 90 to self adjust so as to maintain a minimum injection pressure under different ranges of injection rates. This further ensures the fluid above the choke 90 remains in the dense phase.

Figure 8:
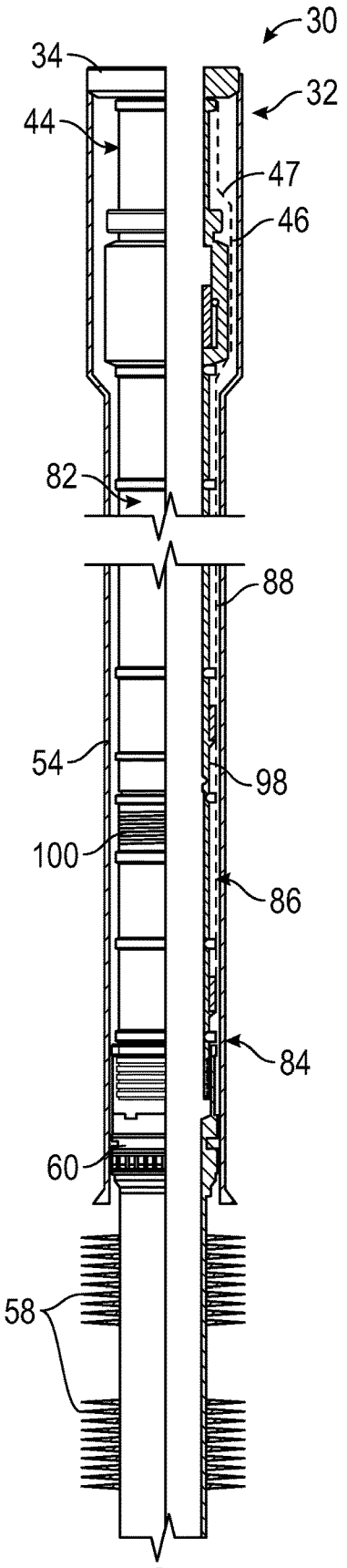
FIG. 8 is an illustration of another example of a well having a borehole with a completion constructed to receive a choke for pressure regulation, according to an embodiment of the disclosure.
Figure 9:
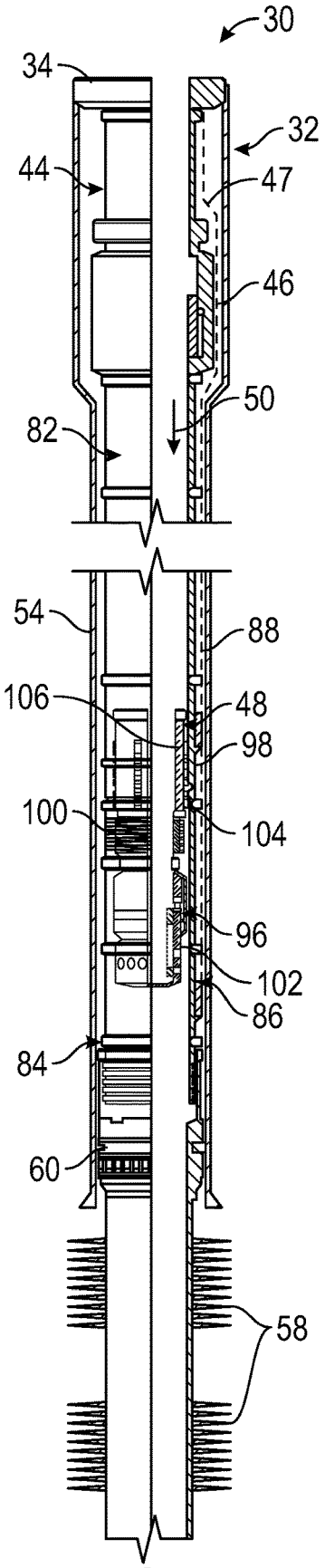
FIG. 9 is an illustration of another example of a well having a borehole with a completion having a choke received in the completion to provide pressure regulation, according to an embodiment of the disclosure.

Referring generally to FIGS. 8 and 9, another embodiment of well injection system 30 and completion 34 is illustrated. In this example, completion 34 is a monobore completion having an appropriate upper completion 82 which is stung, sealed, and anchored in the liner tieback receptacle 84 so as to protect the upper casing from injection fluids.

In this example, choke 48 is in the form of an electronic inline control valve 96. The subsurface safety valve 46 has an internal diameter large enough to allow installation of the electronic control valve 96 via wireline or other suitable conveyance. Completion 34 may comprise a nipple profile 98 and a completion inductive coupler portion 100 (see FIG. 8) positioned to receive the choke 48/electronic control valve 96 (see FIG. 9).

As with some other embodiments, monitoring may be provided by various types of sensor systems 47, and one example comprises the combined optical fiber DAS/DTS system 86 packaged in a hybrid cable 88. In some embodiments, the hybrid cable 88 may include an electric line which connects downhole sensors such as pressure and temperature gauges. The sensors/gauges may be located above and/or below the choke 48 once installed. The hybrid cable 88 also may be used to provide power (and/or comms) to the inductive coupler portion 100. For example, the hybrid cable 88 may comprise a twisted-pair of electrical conductors for providing both power and communications via a twisted-pair electrical backbone established through the inductive coupler portion 100.

According to an embodiment, electronic inline control valve 96 comprises an electrical continuous choke 102, a corresponding inductive coupler portion 104, and a lock mandrel 106 which is received by and locked into the nipple profile 98. The lock mandrel 106 is properly spaced out so that completion inductive coupler portion 100 aligns with the corresponding inductive coupler portion 104. The electrical continuous choke 102 may be a discrete or continuous choke design allowing full visibility and maximum variability for control of injection fluid conditions. In some embodiments, the overall electronic control valve 96 may be constructed to enable electrical measurements prognostic health monitoring and automation of valve control.

The lock mandrel 106 also is constructed to allow passing of the injection fluid 50, e.g. injection CO2 fluid, through ports or other suitable passages. To control flow of the injection fluid 50, the electrical continuous choke 102 may have discrete choke positions or it may be continuously adjustable via a plunger, an adjustable choke insert, or another suitable adjustment mechanism. The continuously adjustable option provides simplicity and control for varying injection conditions in a variety of applications. The electronic inline control valve 96 may utilize a variety of actuators, e.g. electro mechanical actuators, which may comprise linear actuators, roller ball screws, or other actuators connected to, for example, the plunger which is translated linearly to open or close the injection fluid flow path therethrough.

Figure 10:
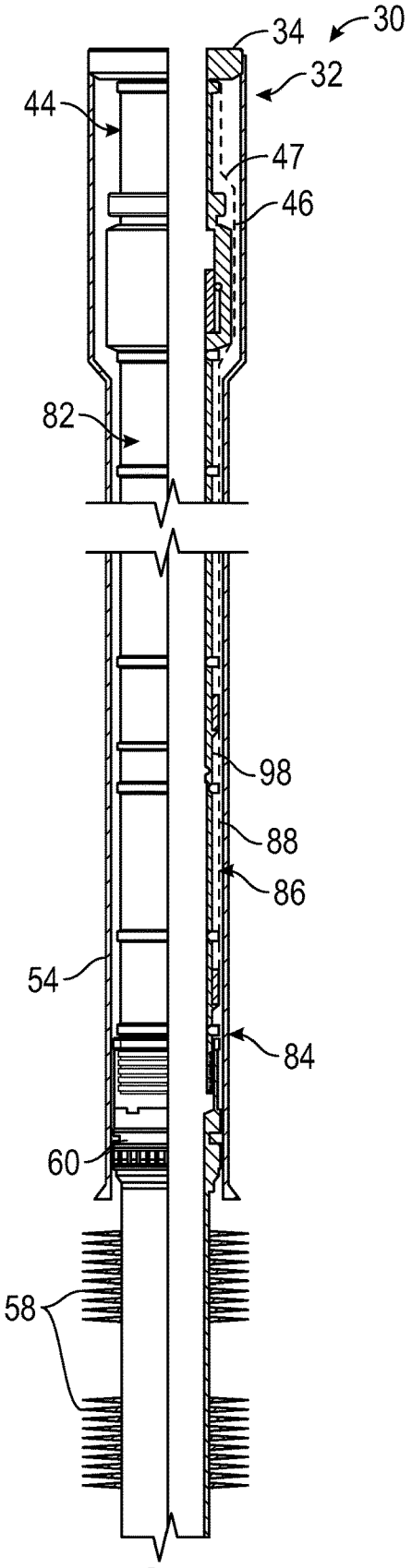
FIG. 10 is an illustration of another example of a well having a borehole with a completion constructed to receive a choke for pressure regulation, according to an embodiment of the disclosure.
Figure 11:
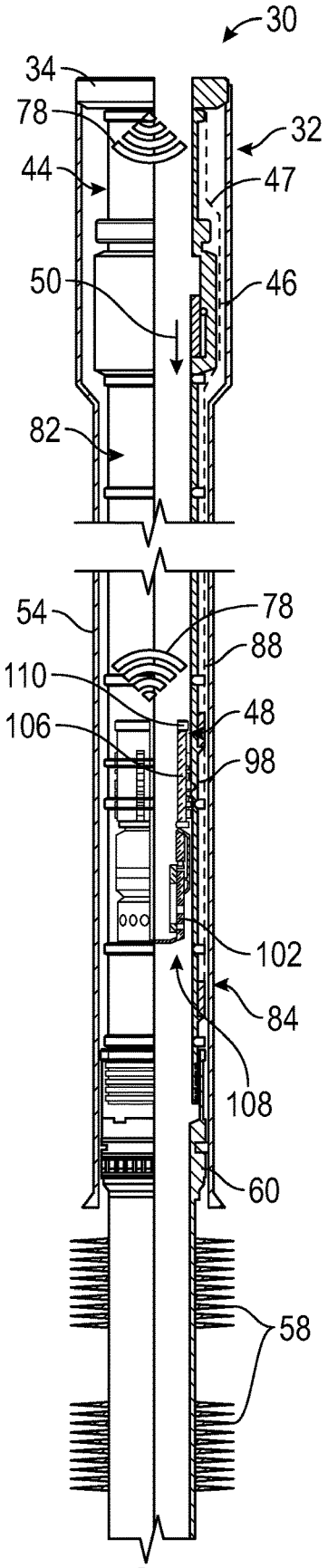
FIG. 11 is an illustration of another example of a well having a borehole with a completion having a choke received in the completion to provide pressure regulation, according to an embodiment of the disclosure.

Referring generally to FIGS. 10 and 11, another embodiment of well injection system 30 and completion 34 is illustrated. In this example, completion 34 is a monobore completion having an appropriate upper completion 82 which is stung, sealed, and anchored in the liner tieback receptacle 84 so as to protect the upper casing from injection fluids.

In this example, choke 48 is in the form of a wireless electrical choke 108. The subsurface safety valve 46 has an internal diameter large enough to allow installation of the wireless choke 108 via wireline or other suitable conveyance. Completion 34 similarly may comprise the nipple profile 98 (see FIG. 10) positioned to receive the wireless electrical choke 108 (see FIG. 11). As with certain other embodiments described herein, monitoring may be provided by various types of sensor systems 47, and one example comprises the combined optical fiber DAS/DTS system 86 packaged in a hybrid cable 88. In some embodiments, the hybrid cable 88 may include an electric line which connects downhole sensors such as pressure and temperature gauges.

According to an embodiment, wireless electrical choke 108 comprises electrical continuous choke 102, lock mandrel 106 which is received by and locked into the nipple profile 98, and a wireless power and comms module 110. In some embodiments, power may be generated downhole via, for example, downhole generator 74. Alternatively, power may be supplied downhole via hybrid cable 88 or another suitable power cable. The wireless electrical choke 108 may be a discrete or continuous choke design constructed to enable operation with the desired flow rates and pressure differentials so as to maintain the desired phases of the injection fluid 50.

Communications with the downhole wireless electrical choke 108 may be achieved via various surface pulse technologies, e.g. mud pulse technologies, or by creating pulses via downhole generator 74. For example, the pulses may be established by controlled interruptions of impeller/turbine 76. The wireless electrical choke 108 and/or portions of the choke 108 may be selectively deployed and retrieved as desired for a given operation and for repair or servicing.

Accordingly, well injection system 30 enables a back pressure regulation method for gas or dense phase fluid injections by facilitating management of the injection conditions. Back pressure control can be provided by a variety of downhole chokes 48, e.g. sprung or piloted mechanical chokes, hydraulically controlled chokes, and electrically controlled chokes having predetermined choke positions, discrete choke positions, or continuously variable choke positions.

The chokes 48 may be installed permanently along with the completion 34 or they may be constructed for dropping into the completion 34 via intervention, e.g. wireline, coiled tubing, slickline, or other suitable intervention technique. In some embodiments, the choke 48 may be in the form of a wirelessly powered choke using, for example, a turbine generator to generate local electrical power.

Depending on the parameters of a given operation, the wireless communication may be bidirectional with the surface and may be achieved via pulsing, e.g. pulsing using impeller/turbine 76 and downhole electronics. The pressure pulses may be received and detected via suitable flowing pressure sensors, pipe strain measurement sensors, or other suitable sensors.

In some embodiments, the chokes 48 may utilize check valve 62, e.g. a self-closing flapper type device. Various types of check valves 62 or other components may be used to provide a self-closing feature so that once pressure or flow reduces below a certain predetermined level, the choke 48 closes to eliminate reverse flow from the reservoir/formation 38.

Overall, the well injection system 30 facilitates a variety of techniques and enhanced injection including allowing a higher injection/disposal rate for CO2 injection applications without undesirable temperature drops. The various structures described herein also can simplify testing of subsurface safety valve 46. The well injection system 30 often helps to simplify the distribution of CO2 and/or other injection fluids to different wells during fluctuations in supply. Because the choke 48 is downhole, the thermal impacts of adjusting the flow or pressure of the injected fluid 50 are less compared to systems in which adjustment is made at the surface. Certain automated or active embodiments facilitate remote actuation capabilities without having an operator on location. Embodiments described herein also may reduce the need for intervention activities while simplifying and lowering costs with respect to various injection operations.

Depending on reservoir properties, production objectives, type of equipment employed, and/or other parameters of a given job, the number and type of well injection system components selected may vary. For example, the type of choke 48 may vary depending on the parameters of a given environment and operation. The length, sections, components, and features of completion 34 may change according to the specifics of a given job. Similarly, the communication and power components associated with various chokes 48 and completion 34 may be changed while still retaining the desired protection against unwanted temperature drops.

Although a few embodiments of the disclosure have been described in detail above, those of ordinary skill in the art will readily appreciate that many modifications are possible without materially departing from the teachings of this disclosure. Accordingly, such modifications are intended to be included within the scope of this disclosure as defined in the claims. It is intended that the scope of the disclosure herein should not be limited by the particular embodiments described above.

What is claimed is:

1. A method for regulating pressure in a borehole, comprising:

suspending a liner downhole in the borehole via a liner hanger;

running a completion downhole within the liner, wherein the completion includes an inner tubular having an interior bore;

positioning a choke within the interior bore of the inner tubular of the completion;

delivering an injection fluid down through the completion such that the injection fluid flows through the choke in the interior bore; and using the choke disposed in the interior bore to control pressure of the injection fluid such that the injection fluid above the choke is maintained at a pressure above the liquid to gas transition line of the injection fluid.

2. The method as recited in claim 1, further comprising forming a seal between the completion and the liner with a packer.

3. The method as recited in claim 2, further comprising employing a subsurface safety valve along the completion at a location above the liner.

4. The method as recited in claim 3, wherein suspending comprises suspending the liner from well casing via the liner hanger.

5. The method as recited in claim 3, wherein the choke is a passive choke.

6. The method as recited in claim 3, wherein the choke is an active choke.

7. The method as recited in claim 3, wherein the choke is in the form of a wireless active choke.

8. The method as recited in claim 3, wherein the choke is an inline flow control valve.

9. The method as recited in claim 3, wherein the choke is a drop-in mechanical choke.

10. The method as recited in claim 3, wherein the choke is an electrical choke.

11. The method of claim 10, wherein the liner includes an inductive coupler portion and the electrical choke includes an inductive coupler, and wherein running the completion downhole includes aligning the inductive coupler of the electrical choke with the inductive coupler portion of the liner.

12. The method as recited in claim 3, wherein the choke is a wireless, electrical choke.

13. The method of claim 3, wherein the completion comprises an upper completion portion including the subsurface safety valve and a lower completion portion including the choke, and wherein the injection fluid flows from the subsurface safety valve through the choke in the lower completion portion.

14. A system for use in a well, comprising:

a completion disposed in a liner suspended within a borehole, the completion being configured to accommodate an injection operation, wherein the completion includes an inner tubular having an interior bore configured to deliver an injection fluid;

a subsurface safety valve positioned along the completion; and a choke located within the interior bore of the inner tubular of the completion at a location downhole of the subsurface safety valve, the choke being configured to control pressure of the injection fluid such that the injection fluid within the interior bore above the choke is maintained at a pressure above a phase transition line of the injection fluid so as to protect the subsurface safety valve against an unwanted decrease in temperature.

15. The system as recited in claim 14, wherein the liner is suspended within the borehole via a liner hanger, and wherein the completion is disposed in the liner such that the choke is located within the liner while the subsurface safety valve is located uphole from the liner.

16. The system as recited in claim 14, wherein the choke comprises a passive choke.

17. The system as recited in claim 14, wherein the choke comprises an active choke.

18. The system as recited in claim 14, wherein the choke comprises a wireless active choke.

19. The system as recited in claim 14, wherein the choke comprises an electrically powered choke.

20. A method, comprising:

deploying a completion into a liner suspended in a borehole, the completion including an inner tubular having an interior bore;

providing the completion with equipment for facilitating a desired injection operation;

positioning a choke below the equipment and within the interior bore of the inner tubular of the completion;

delivering an injection fluid down through the interior bore of the completion; and using the choke to control pressure of the injection fluid such that the injection fluid above the choke is maintained at a pressure above a phase transition line of the injection fluid so as to protect the equipment and the borehole against an unwanted decrease in temperature due to phase change.

21. The method as recited in claim 20, wherein delivering the injection fluid comprises delivering carbon dioxide (CO2).

22. The method as recited in claim 20, wherein the liner is suspended in the borehole via a liner hanger.

* * * * *